United States Patent [19]

Meyers

[11] Patent Number: 4,890,600

[45] Date of Patent: Jan. 2, 1990

[54] FIREPLACE BURNING SIMULATOR UNIT

[75] Inventor: Wayne E. Meyers, Batavia, Ill.

[73] Assignee: Genesis Technology, Batavia, Ill.

[21] Appl. No.: 262,800

[22] Filed: Oct. 26, 1988

[51] Int. Cl.[4] ..... F24C 5/02

[52] U.S. Cl. ..... 126/512; 126/93; 362/806

[58] Field of Search ..... 431/125; 362/810, 92, 362/457, 806; 126/512, 92 R, 93, 94; 219/344, 368

[56] References Cited

U.S. PATENT DOCUMENTS

| | | | |
|---|---|---|---|
| 1,867,740 | 7/1932 | Guy | 219/368 |
| 3,636,307 | 1/1972 | Pearce | 219/344 |
| 3,742,189 | 6/1973 | Conroy et al. | 219/344 |
| 4,573,905 | 3/1986 | Meyers | 126/512 |
| 4,726,351 | 2/1988 | Whittaker et al. | 126/512 |

FOREIGN PATENT DOCUMENTS

| | | | |
|---|---|---|---|
| 455683 | 7/1968 | Switzerland | 219/344 |
| 2075665 | 11/1981 | United Kingdom | 219/344 |

*Primary Examiner*—Ira S. Lazarus
*Assistant Examiner*—Christopher Hayes
*Attorney, Agent, or Firm*—John L. Schmitt

[57] ABSTRACT

A unit to produce simulated burning and heat includes a lower enclosure that may be conveniently placed on a hearth of a fireplace, for example. Within this enclosure is a light source and a reflection wheel located over a reflective plate. The reflection wheel comprises a series of reflective strips which are positioned along a length of the wheel and radially spaced thereabout. Above the wheel in a top panel of the enclosure is an opening covered by an amber-red colored lens piece. The unit further includes a grate carried by the enclosure and positioned to a rear of the enclosure top panel opening. On the grate is a fuel cell for cans of gel alcohol. In front of the fuel cell is a set of decorative logs which hide the fuel cell from view. During use alcohol in the cans may be ignited to produce heat. Since the products of combustion from burning alcohol are nontoxic, the fireplace may be vented or nonvented. Additionally, a geared motor connected to the reflection wheel and the light source are energized. Light from this source strikes the reflective plate and the rotating reflective strips of the wheel to produce a series of reflections. These many reflections then combine to form light patterns of varying intensity that reflect upward through the lens piece to illuminate ash-like aggregate covering the lens piece, the logs, and interior walls of the fireplace. The light patterns produce an illusion of the logs and hot ash burning with a fiery glow.

9 Claims, 2 Drawing Sheets

FIREPLACE BURNING SIMULATOR UNIT

BACKGROUND OF THE INVENTION

1. Field of the Inventions

This invention relates to units that may be used in place of traditional burning of wood logs in a fireplace and more particularly to a unit that may burn a non-toxic fuel and produce an illusion of burning logs at the same time.

2. Prior Art

Units that simulate burning in a fireplace have been known and in use for many years.

One early fireplace simulation unit is set forth in U.S. Pat. No. 1,867,740. This unit includes a grate covered with a light diffusing material. In a compartment below the grate is a light source provided with a flicker fan. When energized, these produce an illusion of flickering flames in the light diffusing material. Additionally, the unit has an electric heating element for warming ambient air in the room in which the unit is placed.

A more recent fireplace simulation unit is disclosed in U.S. Pat. No. 3,742,189. This unit includes a set of partial artificial logs spaced apart for placement of wire brackets. These brackets hold ornamental strips having flame-like shapes. Aligning with these strips within each of the lower logs is a light bulb. In a housing assembly positioned below the logs is a fan unit and an electric heating element. When the unit is in use, the fan blows air over the heating element to circulate warmed air and over the ornamental strips causing a rippling movement of such. Light from the bulbs in turn reflects from the rippling strips to produce an illusion of flame between the logs.

A still more recent fireplace simulation unit is set out in U.S. Pat. No. 4,573,905 issued to the same inventor as the herein disclosed invention. This recent unit includes a fuel cell for cans of gel alcohol that may be burned safely in a room without ventilation. This cell is hidden from view by a set of artificial logs. The fuel cell is supported by a grate which in turn is carried by a base. Below the grate in a top surface of the base is an opening covered by an amber colored glass piece. Small pieces of rock in turn cover the glass piece. In the base below the glass piece is a light source. During use alcohol in the fuel cell cans may be ignited to produce heat. Additionally, the light may be energized to illuminate upward and produce an illusion that the rock pieces are glowing coals.

SUMMARY OF THE INVENTION

A unit of this invention that produces heat and simulated burning of wood logs includes an enclosure that may form part of a nonvented fireplace or may be readily placed on a hearth of a traditional fireplace, for example. In the enclosure is a light source which is positioned next to a reflection wheel rotatable by a geared motor. This wheel comprises a series of reflective strips which are attached to and extend outward from a twisted wire shaft. These strips are positioned along a length of the shaft and spaced radially about the shaft. Below the reflection wheel on a bottom of the enclosure is a reflective plate which aligns with an opening in a top panel of the enclosure. This opening is covered by an amber-red colored lens which in turn is covered with artificial ash-like material.

The unit further includes a grate that sits on the enclosure top panel. The grate is defined by a set of spaced apart bars having upturned front segments to hold a first of a set artificial log portions. Behind this first log portion is a fuel cell to hold cans containing a gel alcohol fuel. The fuel cell is further screened from view by a second log portion positioned in front of the cell and a third log portion attached to a slidable lid of the fuel cell.

When the unit is to be used, the fuel cell lid is slid rearward to uncover the cans. The gel alcohol then may be ignited to produce heat and warm air in the room in which the unit is located. Additionally, the light source and geared motor may be energized to emit light and slowly rotate the reflection wheel. The emitted light strikes the reflective plate and the reflective strips of the wheel to produce a series of light patterns of varying intensity. These patterns interact and then shine upward and pass through the lens piece. The now amber-red colored patterns of light reflect from the ash on the lens piece, bottom edges of the first and second log portions, and interior walls of the fireplace. As reflected, these patterns of light produce an illusion that the logs are burning and as such are emitting a fiery glow.

This inventive unit to produce heat and simulated burning of wood logs in a fireplace provides several improvements over other like units known or in use.

A first improvement is a truly authentic illusion of the burning logs. The patterns of light that produce the burning illusion vary in both intensity and location. As one portion of a log is subjected to a gradually increasing intensity of light, the light intensity on an adjacent portion is gradually decreasing. These changes of intensity also affect the color of the illusionary burning. Authenticity is further enhanced by subjecting the entire length of a log portion to these changing patterns of amber-red light. Thus, an entire log appears to be burning. This burning effect also is transmitted to and then reflects from the side and rear walls of the fireplace. These dynamic patterns of light, varying in location, intensity and color, are a result of a reflective interaction between the light source, the reflective plate and the slowly rotating reflective strips of the wheel.

A second improvement is that the unit allows a user to produce heat, a burning illusion, or both. The heating function and the burning function are mutually exclusive. It should be appreciated that a pure alcohol gel burns with a colorless, nearly invisible flame. However, an additive may be introduced into the gel to produce visible flaming. Thus, the unit may produce the illusion of burning and blazing, heat producing flame.

DESCRIPTION OF THE PREFERRED EMBODIMENT

Figure 1:
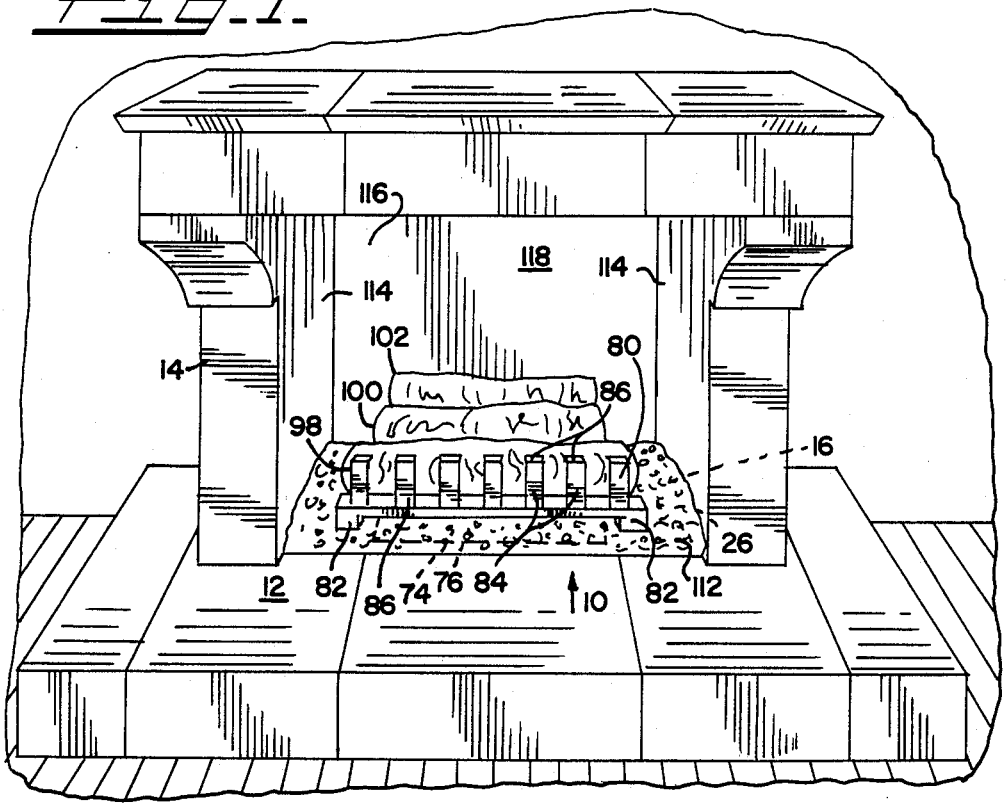
FIG. 1 is perspective view of a simulation burning unit of this invention forming part of an imitation fireplace cabinet.
Figure 2:
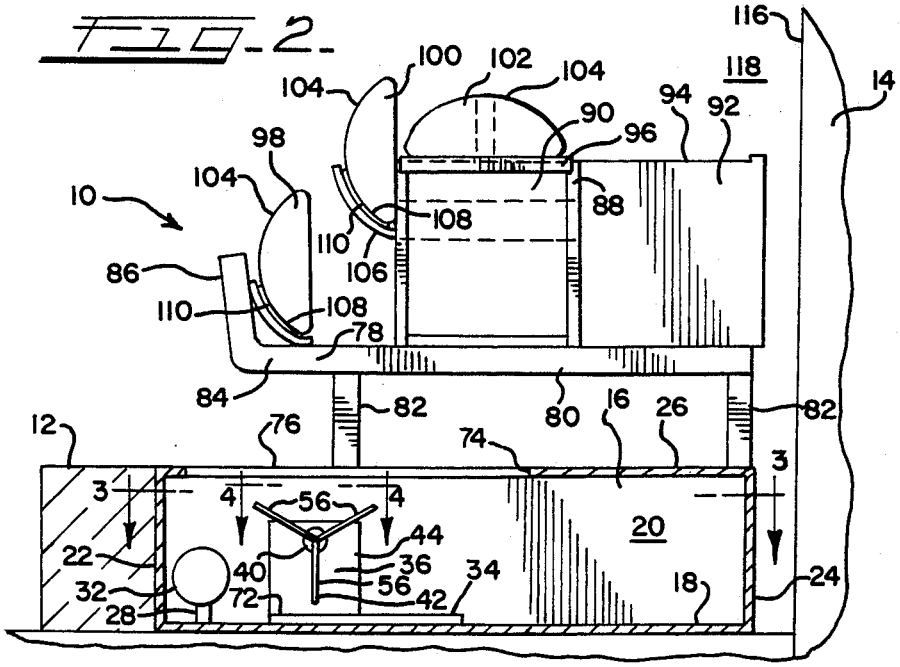
FIG. 2 is a side elevation cross sectional view of the unit of FIG. 1.

A unit of this invention to produce simulated burning and heat in a fireplace is shown generally in FIGS. 1 and 2 and designated 10. In FIG. 1 the unit 10 is shown forming part of a hearth 12 of a fireplace 14. In this case the fireplace 14 is a nonvented display cabinet as set out typically in U.S. Pat. Nos. Des. 292,152 and 292,251. The unit 10 alternatively may be placed on the hearth of a traditional fireplace of masonry construction forming part of a residence, for example.

Figure 3:
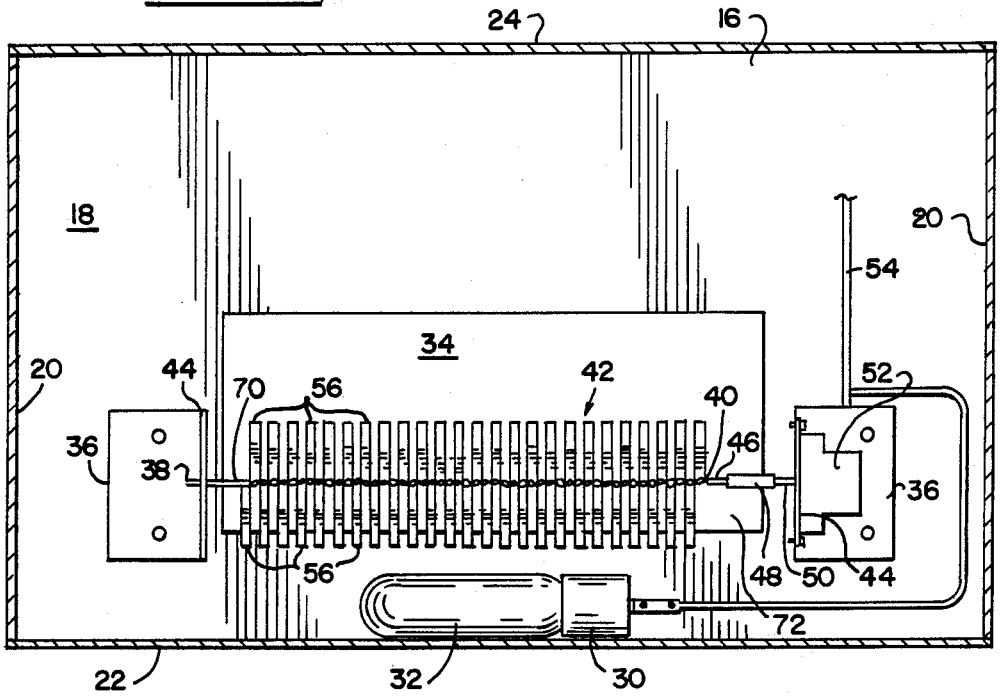
FIG. 3 is a further cross sectional view as seen generally along the line 3—3 in FIG. 2.

As seen in FIGS. 2 and 3, the unit 10 includes a base enclosure 16 defined by a bottom 18, sidewalls 20, a front wall 22, a rear wall 24 and a top panel 26. Extending upward from the enclosure bottom 18 is a bracket 28 to carry a socket 30 for an elongated light bulb 32. Positioned inward from the bracket 28 on the bottom 18 is a reflective plate 34. A pair of spaced apart angle brackets 36 are fastened to the bottom 18 on each side of the plate 34.

A first end 38 of a shaft 40 of a reflection wheel 42 is carried by an upright portion 44 of one angle bracket 36. An opposite end 46 of the shaft 40 is operatively connected by a coupling 48 to an output shaft 50 of geared motor 52. This motor 52 is attached to the upright portion 44 of the other angle bracket 36.

Both the light bulb 32 and the motor 52 are connected to a source of electricity by circuit wires 54. Note that the bulb 32 and the wheel shaft 40 are horizontally aligned and that the bulb 32 is positioned below the shaft 40 of the reflection wheel 42.

As best understood by viewing FIGS. 2–5, the reflection wheel 42 comprises a series of radially spaced apart reflective strips 56. These strips 56 in turn are formed by two sets of spaced apart slits 58,60 which extend inward from side edges 62,64 of a sheet of a reflective plastic material 66, see FIG. 5. Each set of slits 58,60 terminates short of a narrow, center area 68 of the sheet 66. Note the set of slits 58 is longitudinally offset from the other slit set 60.

Figure 4:
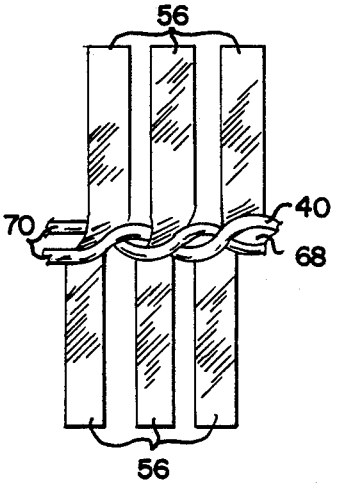
FIG. 4 is a view of a selective portion of a reflection wheel of the unit as seen along the line 4—4 in FIG. 2.
Figure 5:
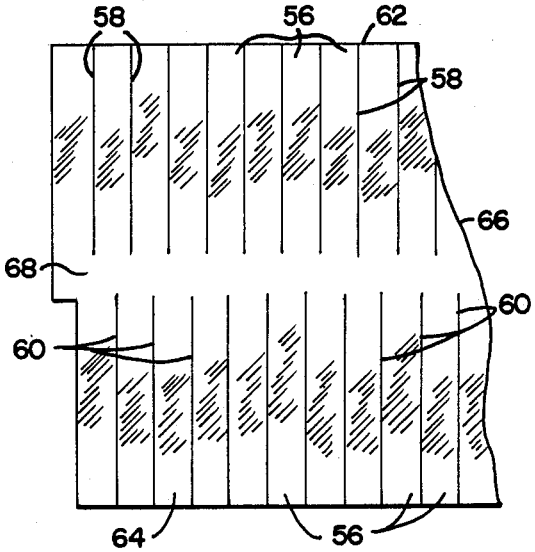
FIG. 5 is a plan view of a portion of a material blank used to form reflective strips comprising a part of the reflection wheel of the unit.

The shaft 40 of the wheel 42 is formed from two wires 70 which first are placed one each on respective sides of the center area 68 of the sheet 66. As seen in FIG. 4, the wires 70 then are twisted so that individual reflective strips 56 project radially outward in a spiral-like pattern from the shaft 40. As seen in FIG. 2, the wires 70 of the shaft 42 have been twisted to a degree that adjacent reflective strips 56 are spaced at approximately 120 degree increments about the shaft 40. This twisting also produces a small degree of pitch in the position of the reflective strips 56, like vanes of a fan. If the shaft wire 70 were twisted more tightly, the radial increment between strips 56 would decrease and the degree of pitch increase. Note further that the reflective strips 56 extend longitudinally nearly an entire length of the shaft 40. The shaft 40 of the reflection wheel 42 is positioned over a front portion 72 of the plate 34.

In the top panel 26 of the base enclosure 16 of the unit 10 is a rectangular shaped opening 74 covered by an amber-red colored lens piece 76 made of glass or other transparent material. This opening 74 is approximately twice the size of the reflective plate 34 and is vertically aligned therewith. Positioned over this top panel opening 74 and lens piece 76 is a front portion 78 of a grate 80.

This grate 80 has two sets of leg pairs 82 that rest on the enclosure top panel 26 and that are positioned respectively on each side of the opening 74. The grate 80 is further defined by a series of spaced apart bars 84 formed with upturned front end portions 86. Positioned on the grate bars 84 inward from the upturned end portions 86 is a fuel cell 88. The cell 88 includes a fire box portion 90 to hold cans of gel alcohol fuel (not shown). Spaced apart sidewalls 92 of the fire box portion 90 extend to a rear of the fire box portion 90. Top edges 94 of these sidewalls 92 in turn form a guide for a slidable lid 96. This lid 96 may be placed on the fuel cell fire box portion 90 to form a cover or slid to the rear to expose the fuel cans therein.

The fuel cell 88 is hidden from view by a set of three decorative log portions 98, 100 and 102. These log portions 98–102 may be made from a noncombustible, ceramic material and have a semicircular cross sectional shape. An outer radiused surface side 104 of each log 98–102 has a wood log appearance. As seen in FIGS. 1 and 2, the first log 98 is positioned against the grate bar upturned end portions 86. The second log 100 is positioned immediately in front of the fuel cell 88 and is carried by a pair of brackets 106 attached respectively to the sidewalls 92 of the fuel cell fire box 90. As positioned, the second log 100 is located above the first log 98. Along a bottom edge 108 of each log 98,100 is a reflective strip 110 of clear plastic material. Note that these strips 110 also have a radiused shape. The third log portion 102 is attached to the fire box lid 96. To complete the fireplace appearance the base enclosure top panel 26 and lens piece 76 may be partially covered with an ash-like material 112, see FIG. 1.

During use the unit 10 may produce heat, simulated burning or both. As discussed briefly above, the unit 10 may be placed on the hearth of a conventional fireplace or form part of the hearth 12 of the fireplace cabinet 14. To produce only heat, the lid 96 of the fire box 90 is slid to the rear to uncover the cans of alcohol gel fuel contained therein. This fuel then may be ignited with a match, for example. Note that burning alcohol produces only water vapor and carbon dioxide, each being nontoxic. Therefore, as heat is being generated, the fireplace cabinet 14 need not be vented to the out-of-doors. To extinguish the burning of the alcohol in the fuel cell 88, the lid 96 is slid forward to cover the fire box 90. When oxygen in the fire box 90 is sufficiently depleted, combustion terminates.

When the unit 10 is to produce simulated burning, a switch (not shown) connecting with the circuit wires 54 may be placed in an "ON" position to energize the light bulb 32 and the geared motor 52. Light from the bulb 32 strikes the reflective plate 34, the reflective strips 56 of the reflection wheel 42 which slowly rotates at about 30 rpm and shines upward through the lens piece 76. As light strikes the reflective plate 34 and the reflective strips 56, it reflects in a compound, interacting manner to produce upward illumination comprising series of light patterns. The intensity of the light in each pattern changes continuously. This change of intensity is a result of a continuous changing of the angle of incidence of light striking and then reflecting from the rotating reflective strips 56 of the reflection wheel 42.

As these dynamic patterns of light pass through the lens 76, color of the light changes from white to an amber-red. It should be understood the light bulb 32 could be so colored in which case the lens piece 76 would be clear or slightly opaque. Note further that the changes of intensity of the light patterns discussed above also produces variations in the color of the light.

These emitted colored light patterns then strike the reflective strips 110 of the logs 98,110 and sidewalls 114 and a rear wall 116 defining an interior space 118 of the fireplace cabinet 14.

Light reflects from all of these surfaces 110, 114 and 116 to be viewed by persons in the room in which the fireplace cabinet 14 and included unit 10 are located. As viewed, the logs 98,100 are perceived as being on fire as the bottom edges 108 of the logs 98,100 and the ash 112 are seen to have a fiery glow. As occurs when burning a log of natural wood, portions of the logs 98,100 appear to burn more intensely from time to time. Also, as occurs when burning natural wood logs in a conventional fireplace, the interior surfaces 114, 116 are illuminated by this illusionary burning. Placement of the switch in its "OFF" position de-energizes the light bulb 32 and motor 52 and terminates the illusion.

While an embodiment, uses and advantages of this invention have been shown and described, it should be understood that this invention is limited only by the scope of the claims. Those skilled in the art will appreciate that various modifications or changes may be made without departing from the scope and spirit of the invention, and these modifications or changes may result in further uses and advantages.

What I claim is:

1. A unit to create an illusion of burning of natural wood logs in a fireplace, said unit comprising:

an enclosure defined in part by a bottom and a top panel spaced thereabove, a reflective plate fitting on said enclosure bottom, a reflection wheel including an elongated shaft carried by said enclosure and spaced between said enclosure bottom and said top panel to align with said reflective plate, said wheel having numerous, individual reflective strips attached to and positioned along said shaft and radially spaced thereabout in a spiral-like pattern, rotating means operatively connected to said wheel to slowly rotate said wheel, an elongated light source carried by said enclosure and positioned to proximately align with said reflection wheel and form an unobstructed space between said reflective plate, said light source and said wheel for direct passage of light therebetween, lens means positioned over an opening in said enclosure top panel with said opening aligning with said reflective plate and said wheel, said lens means prepared to transmit light from said light source therethrough having an amber-red like color, and fireplace paraphernalia carried on said enclosure top panel, said paraphernalia including a set of spaced apart log portions positioned over said lens means with said log portions having enhanced reflective lower edges, wherein during use of said unit light from said source, light reflection from said reflective plate and light selectively reflecting from said slowly rotating reflective strips of said wheel may mix to create patterns of light that illuminate upward to pass through said lens means and reflect from said bottom edges of said log portions to create said illusion of burning of said log portions.

2. A fireplace unit to produce an illusion of burning logs on a hearth of a fireplace, said unit comprising:

an enclosure prepared to be carried on said hearth, said enclosure defined by a bottom, spaced apart sidewalls, a connecting front and rear wall, and a top panel with an opening formed therein, an elongated light bulb carried by said enclosure between said bottom and said top panel, a reflection wheel including a shaft having ends carried respectively by spaced apart angle brackets attached to said enclosure bottom, and a series of reflective strips carried by said shaft and extending continuously between said shaft ends with said strips projecting radially outward from said shaft and spaced radially apart in a spiral-like pattern, a geared motor attached to one angle bracket and operatively connected to said adjacent shaft end with said motor and said bulb prepared to be operatively joined to a source of electrical power, a reflective plate carried on said enclosure bottom, said plate positioned under said reflection wheel, an amber-red lens attached to said top panel to cover said opening in said top panel, a grate having pairs of legs carried on said enclosure top panel and positioned respectively on each side of said top panel opening, said grate further defined by a series of spaced apart bars formed with upturned ends, a set of artificial log portions carried longitudinally by said grate, a first log portion of said set positioned immediately inward from said bar upturned ends and a second log portion of said set spaced above and to a rear of said first log portion, each said log portion formed with a reflective bottom edge visible from in front of said fireplace, said reflection wheel shaft formed by a pair of elongated wires, and said reflective strips formed from a sheet of flexible material having light reflective characteristics, said sheet formed with sets of spaced apart slits with one each of said slit sets extending inward from respective longitudinal edges of said sheet and terminating at a narrow area in a middle of said sheet, and one said set of slits being longitudinally offset from said other set of slits, wherein one each of said shaft wires is placed on respective sides of said sheet narrow area and then said wires are twisted to place said reflective strips in said spiral-like pattern and with a slight degree of pitch; and, during operation of said unit, light from said bulb strikes said reflective plate and said reflective strips of said reflection wheel as said wheel is slowly rotated by said motor, said striking light reflects therefrom and intermixes to create upward illuminating light patterns having varying intensities, said light patterns then passing through said lens to be transformed from a white to a varying amber-red color and striking said bottom edges of said log portions and reflecting outward to form said illusional view of said log portions burning.

3. A fireplace unit as defined by claim 2 and further characterized by said unit including a fuel cell carried on said grate, said fuel cell comprising:

a fire box prepared to hold containers of a gel alcohol fuel with said fire box defined in part by rearward extending sidewalls having top edges forming a guide for a lid selectively slidable to a position to cover or uncover said containers, and end brackets attached to said fire box sidewalls and extending forward therefrom to hold said second log portion.

4. A fireplace unit as defined by claim 2 and further characterized by:

said elongated light bulb positioned below said reflection wheel shaft with said shaft located over a front portion of said reflective plate, and said plate in substantial vertical alignment with said enclosure top panel opening.

5. A fireplace unit as defined by claim 4 and further characterized by, said top panel opening being larger in area than said reflective plate.

6. A fireplace unit defined by claim 2 and further characterized by said unit including, an ash-like material dispensed on said enclosure top panel and said lens, wherein said light patterns reflect from said material to create an illusion of said material forming glowing coals from said burning log portions.

7. A fireplace unit as defined by claim 2 and further characterized by, said hearth forming part of a nonvented fireplace cabinet.

8. A unit for fireplace burning simulation including emitter means to create a visual burning illusion, said emitter means comprising:

an elongated light source carried by said emitter means, a reflective surface carried by said emitter means and positioned below said light source, a rotatable wheel having a series of individual, spaced apart reflective strips formed into a spiral-like array about and along a length of said wheel, said wheel carried by said emitter means and positioned to proximately align with said light source and above said reflective surface to form an unobstructed space between said light source, said wheel and said reflective surface, and lens means carried by said emitter means and positioned above said wheel to allow an upward illumination having an amber-red color, wherein light from said source and light reflecting from said reflective surface selectively passing through said wheel, selectively reflecting from said wheel reflective strips, and selectively obstructed by said wheel strips may mix and form said upward illumination defining dynamic patterns of flickering light which may strike and reflect from fireplace paraphernalia positioned above said lens means to create said visual burning illusion.

9. A unit for fireplace burning simulation as defined by claim 8 and further characterized by, said lens means being partially covered by an ash-like material to reflect said dynamics light patterns and create a visual illusion of glowing coals.

* * * * *